US007658661B2

(12) United States Patent
Ansolabehere

(10) Patent No.: US 7,658,661 B2
(45) Date of Patent: Feb. 9, 2010

(54) ORNAMENTAL SOUND MODULE FOR A BALLOON

(75) Inventor: Paul Ansolabehere, Minnetonka, MN (US)

(73) Assignee: Anagram International, Inc., Minneapolis, MN (US)

( * ) Notice: Subject to any disclaimer, the term of this patent is extended or adjusted under 35 U.S.C. 154(b) by 373 days.

(21) Appl. No.: 11/472,580

(22) Filed: Jun. 22, 2006

(65) Prior Publication Data

US 2006/0292961 A1 Dec. 28, 2006

Related U.S. Application Data

(60) Provisional application No. 60/692,745, filed on Jun. 22, 2005.

(51) Int. Cl.
*A63H 27/10* (2006.01)

(52) U.S. Cl. ..... 446/220; 446/397

(58) Field of Classification Search ..... 446/220, 446/221, 222, 223, 224, 225, 226, 397, 404, 446/484

See application file for complete search history.

(56) References Cited

U.S. PATENT DOCUMENTS 3,987,258 A * 10/1976 Tsutsui et al. ..... 381/334
4,638,207 A * 1/1987 Radice ..... 310/328
4,704,934 A * 11/1987 Nosrati ..... 84/94.2
4,801,478 A * 1/1989 Greenblatt ..... 428/7
4,810,997 A * 3/1989 Kudo et al. ..... 340/384.6
4,823,907 A * 4/1989 Hoshi ..... 181/148
5,108,338 A * 4/1992 Margolis ..... 446/220
5,641,164 A * 6/1997 Doederlein et al. ..... 273/237
5,764,131 A * 6/1998 Twining et al. ..... 340/311.2
6,064,746 A * 5/2000 Nakamura et al. ..... 381/351
6,482,065 B1 * 11/2002 Blackman ..... 446/220
6,687,381 B2 * 2/2004 Yanagawa et al. ..... 381/423
6,821,183 B2 * 11/2004 Blackman et al. ..... 446/220
6,925,191 B2 * 8/2005 Petroff et al. ..... 381/423
2003/0054728 A1 * 3/2003 Piepenbrink ..... 446/220
2003/0138120 A1 * 7/2003 Tripoli, III ..... 381/190
2005/0129261 A1 * 6/2005 Ito et al. ..... 381/190

* cited by examiner

*Primary Examiner*—John Ricci
(74) *Attorney, Agent, or Firm*—Gerald E. Helget; Nelson R. Capes; Briggs and Morgan, P.A.

(57) ABSTRACT

An ornamental sound music module for a balloon has an ornamental suitably raised face with a peripheral lip or flange. A backer board is adhered to the rear of the ornamental face creating a housing. A central aperture is within the backer board with an annular support rim for supporting the outer disc portion of a piezoelectric buzzer in a firm manner to encourage the central regions of the buzzer to generate optimum music. A circuit board is contained within the housing and is connected to the buzzer by wires. The backer board suitably has an adhesive to allow the ornamental sound module to be affixed to a metalized nylon film balloon.

10 Claims, 3 Drawing Sheets

ORNAMENTAL SOUND MODULE FOR A BALLOON

BACKGROUND OF THE INVENTION

This invention claims priority to provisional application No. 60/692,745, filed Jun. 22, 2005, entitled ORNAMENTAL SOUND MODULE FOR A BALLOON, and relates to metalized nylon film balloons, and more particularly, to an ornamental sound module for such balloons.

Music modules with various ways of affixation in and onto balloons are illustrated in U.S. Pat. Nos. 4,638,207; 4,704,934; 4,823,907; 5,108,338; 6,482,065; 6,821,183 and Patent Application Publication No. 2003/0138120.

Problems with these music modules in combination with balloons renders them too expensive for general commercialization, technically too complex and often too heavy for a helium filled balloon which is designed to float.

SUMMARY OF THE INVENTION

An ornamental sound music module for a balloon has an ornamental suitably raised face with a peripheral lip or flange. A backer board is adhered to the rear of the ornamental face creating a housing. A central aperture is within the backer board with an annular support rim for supporting the outer disc portion of a piezoelectric buzzer in a firm manner to encourage the central regions of the buzzer to generate optimum music. A circuit board is contained within the housing and is connected to the buzzer by wires. The backer board suitably has an adhesive to allow the ornamental sound module to be affixed to a metalized nylon film balloon.

A principal object and advantage of the present invention is that the ornamental sound module may be attached to any balloon structure made of MYLAR® or metalized nylon film, clear plastic, latex or other vinyl inflated structures.

Another principal object and advantage of the present invention is that the ornamental sound module is inexpensive, simple and easily attaches to any object including balloons.

DETAILED SPECIFICATION

Figure 1:
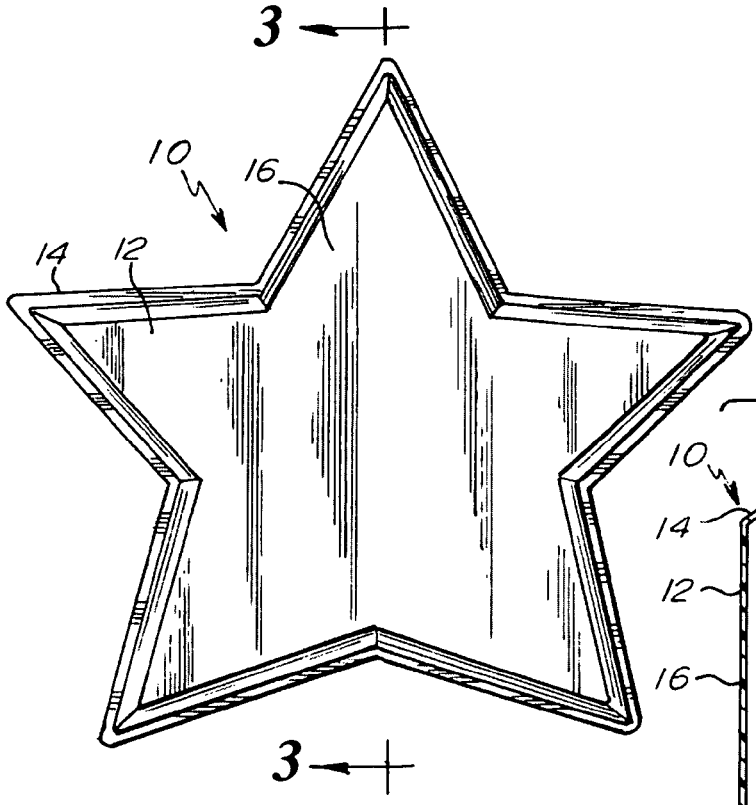
FIG. 1 is a front elevational view of the first embodiment of the ornamental sound module for a balloon.
Figure 3:
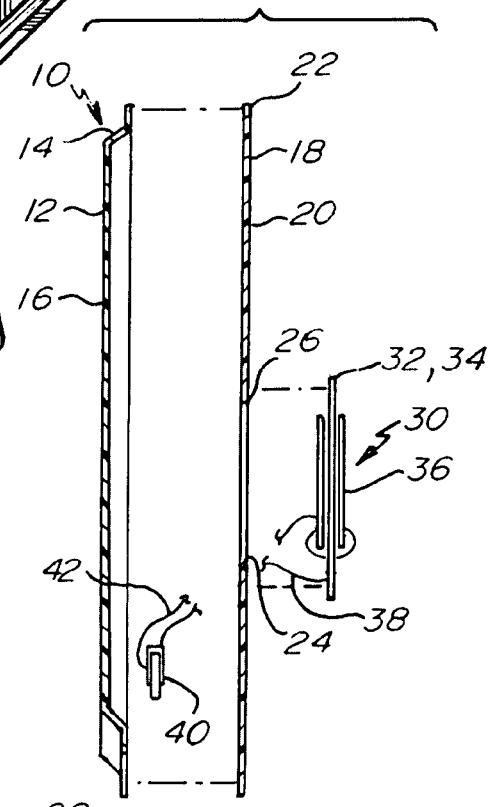
FIG. 3 is an exploded schematic side elevational view of the module.
Figure 2:
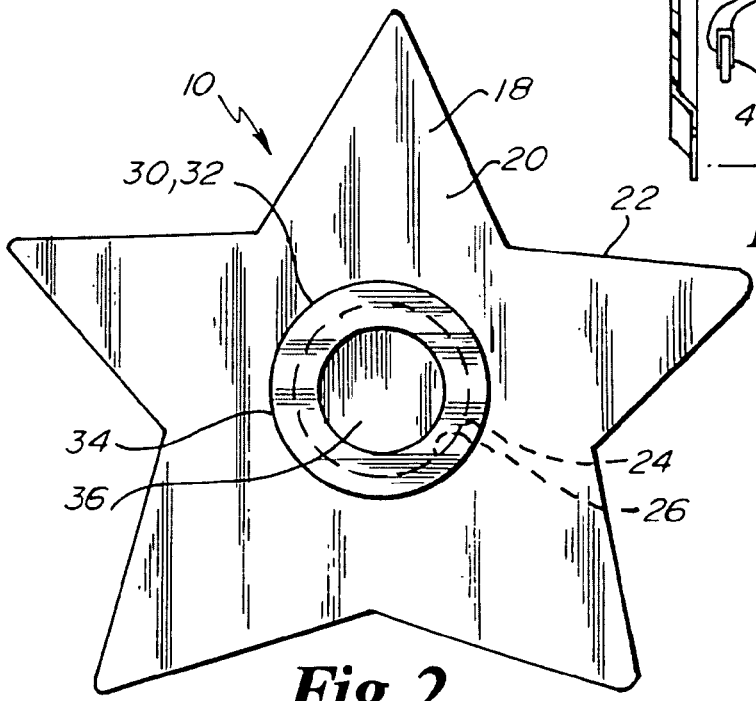
FIG. 2 is a rear elevational view of the module.
Figure 4:
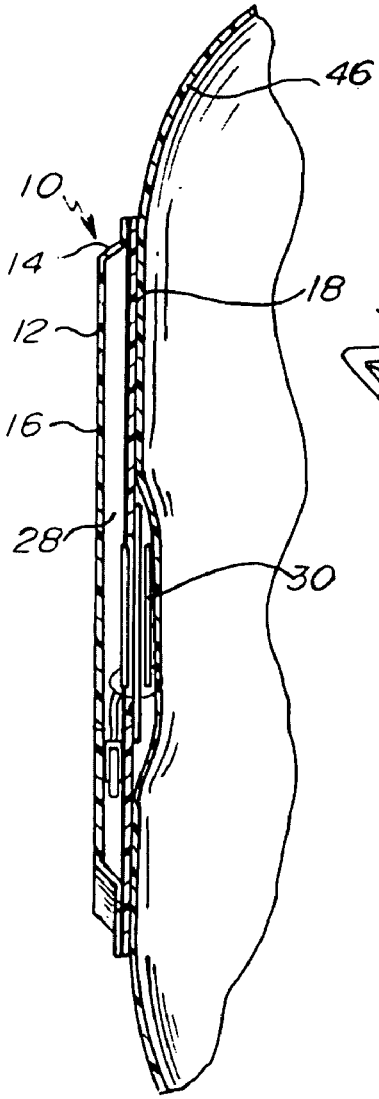
FIG. 4 is a side elevational schematic of the assembled module attached to a balloon.

The ornamental sound module 10 for a balloon 46 in it's first embodiment is shown in FIGS. 1 through 4.

The module 10 has a raised star ornamental front portion 12 suitably made of plastic having a peripheral lip or flange 14 therearound and a front face 16 which suitably may be subject to further artistic renderings. The backer board 18 is suitably made of light weight styrofoam and has a face 20. The peripheral edge 22 of the backer board 18 suitably has adhesive thereon for securing to the lip or flange 14 of the plastic raised star 12. A central aperture 24 is provided having a buzzer support rim 26 therearound. By adhering the raised star 12 and backer board 18 at their peripheries 14 and 22, housing 28 is created. Piezoelectric buzzer 30 is suitably constructed of a metal disc 32 of relative large diameter having a peripheral edge 34 therearound. Smaller crystal or ceramic plates 36 are fixed to opposite sides of the metal disc 32 and are suitably connected by appropriate wiring 38.

Within housing 28 is a circuit board 40 which suitably supports a sound chip, a switch, a battery and wires 42 for connection to the wires 38 of buzzer 30. The switch maybe mechanical, electronic or a motion detector.

The ornamental sound module 10 maybe adhered to a metalized nylon film balloon 46, or other inflated object suitably made of clear plastic latex or vinyl, by adhesive on face 20.

Figure 5:
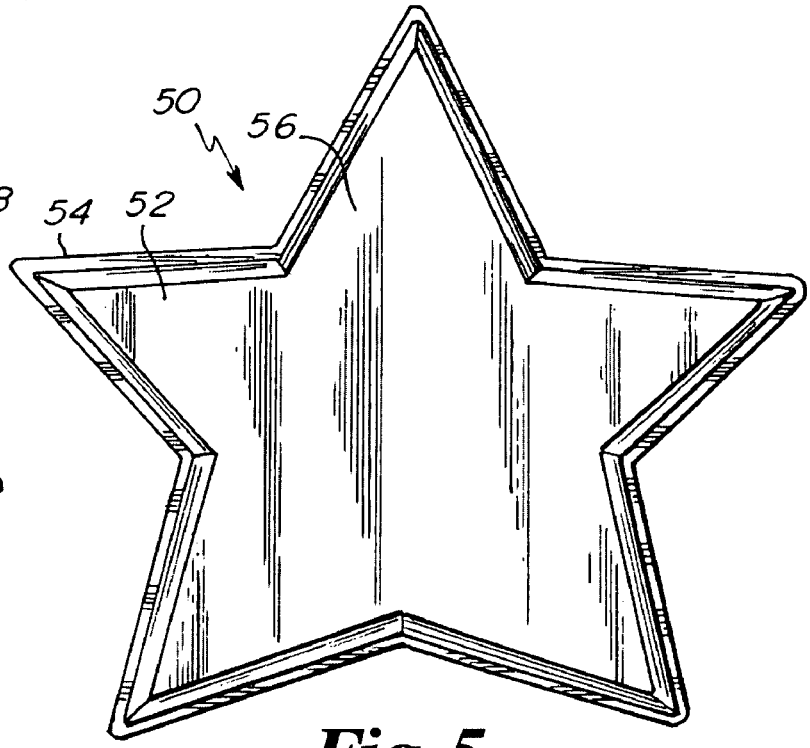
FIG. 5 is a front elevational view of the second embodiment of the ornamental sound module for a balloon.
Figure 6:
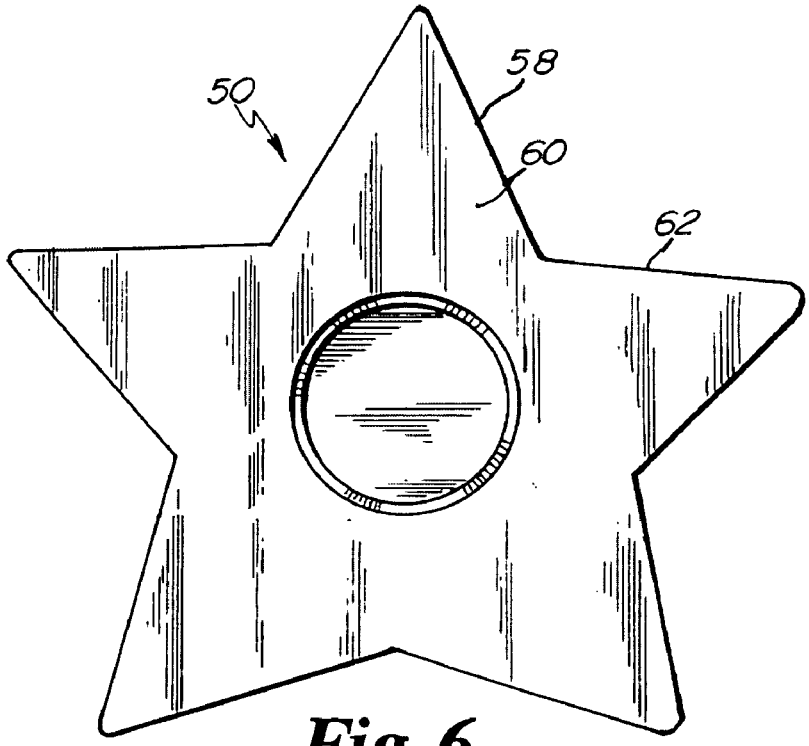
FIG. 6 is a rear elevational view of the second embodiment of FIG. 5.
Figure 7:
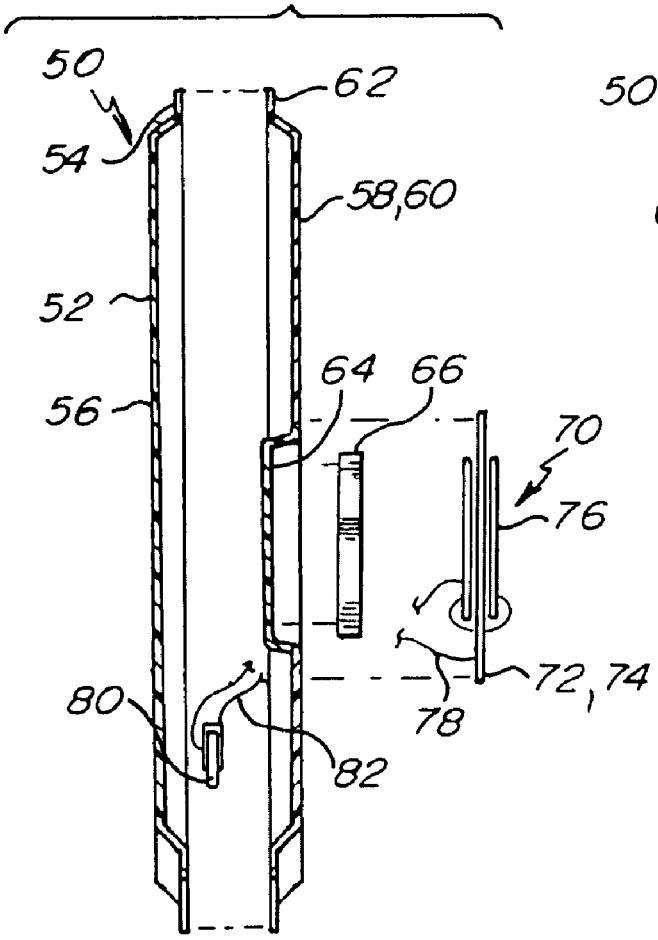
FIG. 7 is an exploded schematic side elevational view of the second embodiment.
Figure 8:
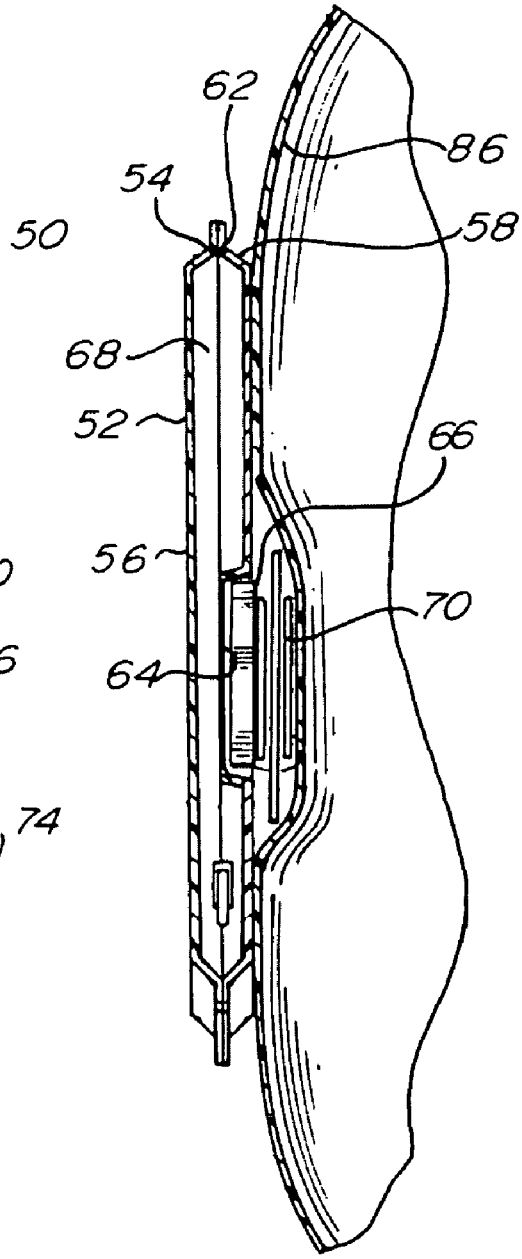
FIG. 8 is a schematic side elevational view of the module assembled and mounted to a balloon.

Referring to FIGS. 5 through 8 the second embodiment of the ornamental sound module 50 for a balloon 86 maybe viewed.

The sound module 50 has a raised star front portion 52 with a peripheral lip or flange 54 and a front face 56 which may further be ornamentally decorated. In this embodiment, the backer board 58 is a second raised star like portion suitably made of plastic having a face 60. A peripheral edge 62 of the backer board 58 is suitably adhered to the peripheral flange 54 of the front raised star portion 52 thereby creating housing 68 therewithin. Backer board 58 suitably has a central recess 54 which supports a plastic spacer 66 which may be adhered thereat.

A piezoelectric buzzer 70 suitably has a metal disc 72 with a peripheral edge 74 and crystal or ceramic plates 76 suitably connected by wiring 78. The buzzer 70 is adhered to the plastic spacer 66 which is adhered within the central recess 64. Within the housing is a circuit board 80 suitably supporting a sound chip, switch, battery and wires 82 to be connected to the buzzer 70. Adhesive maybe applied to the backer board 58 at face 60 with a film protecting the adhesive quality until use. At the appropriate time, the liner is removed and the ornamental sound module 54 maybe adhered to a metalized nylon film balloon or other clear plastic, latex or other vinyl inflatable objects.

Unless otherwise defined, all technical and scientific terms used herein have the same meaning as commonly understood by one of ordinary skill in the art to which this invention belongs. Although methods and materials similar to or equivalent to those described herein can be used in the practice or testing of the present invention, suitable methods and materials are described above. All publications, patent applications, patents, and other references mentioned herein are incorporated by reference in their entirety to the extent allowed by applicable law and regulations. In case of conflict, the present specification, including definitions, will control.

The present invention may be embodied in other specific forms without departing from the spirit or essential attributes thereof, and it is therefore desired that the present embodiment be considered in all respects as illustrative and not restrictive, reference being made to the appended claims rather than to the foregoing description to indicate the scope of the invention.

What is claimed:

1. An ornamental sound module for a balloon, comprising:

(a) a housing, wherein the housing further comprises a front portion and a backer board secured to the front portion, wherein the front portion further comprises a raised ornamental portion having a first peripheral flange there-around and wherein the backer board further comprises a raised ornamental second portion having a second peripheral flange there-around, the first peripheral flange and the second peripheral flange being joined together to create the housing;

(b) a face on the backer board with an adhesive thereon adaptable to adhere the face to the balloon;

(c) a buzzer aperture in the housing, further comprising a support rim;

(d) a piezoelectric buzzer supported on the support rim; and (e) a circuit board within the housing, the circuit board further comprising a sound chip, a switch, a battery, and wiring connecting the circuit board to the piezoelectric buzzer.

2. The ornamental sound module of claim 1, wherein the front portion is comprised of a plastic.

3. The ornamental sound module of claim 1, wherein the backer board further comprises plastic foam.

4. The ornamental sound module of claim 1, wherein the first peripheral flange is secured to the backer board's second peripheral flange.

5. The ornamental sound module of claim 4, wherein the first peripheral flange is adhered to the second peripheral flange.

6. The ornamental sound module of claim 1, wherein the backer board further comprises a recess supporting a plastic spacer adhered thereto.

7. The ornamental sound module of claim 6, wherein the piezoelectric buzzer is adhered to the plastic spacer.

8. The ornamental sound module of claim 1, wherein the piezoelectric buzzer further comprises a metal disc having a peripheral edge there-around.

9. The ornamental sound module of claim 8, further comprising smaller plates affixed to opposite sides of the metal disc and connected by wiring to the circuit board.

10. The ornamental sound module of claim 1, further comprising a film removably applied to the adhesive.

* * * * *

UNITED STATES PATENT AND TRADEMARK OFFICE

CERTIFICATE OF CORRECTION

PATENT NO. : 7,658,661 B2
APPLICATION NO. : 11/472580
DATED : February 9, 2010
INVENTOR(S) : Paul Ansolabehere It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 597 days.

Signed and Sealed this

Thirtieth Day of November, 2010

David J. Kappos

David J. Kappos
*Director of the United States Patent and Trademark Office*